United States Patent [19]

Swartz

[11] Patent Number: 4,698,942

[45] Date of Patent: Oct. 13, 1987

[54] CLIP FOR HOLDING AND SPACING SIDING PANELS

[76] Inventor: Gary D. Swartz, 818 Cobblestone Ct., Ripon, Calif. 95366

[21] Appl. No.: 16,955

[22] Filed: Feb. 20, 1987

Related U.S. Application Data

[63] Continuation-in-part of Ser. No. 732,131, May 9, 1985, abandoned.

[51] Int. Cl.[4] ..... E04D 1/34

[52] U.S. Cl. ..... 52/99; 52/547; 52/551

[58] Field of Search ..... 52/98, 99, 547, 549, 52/551, 714, DIG. 1

[56] References Cited

U.S. PATENT DOCUMENTS

| | | | |
|---|---|---|---|
| 2,110,198 | 4/1938 | Burson . | |
| 2,227,570 | 1/1941 | Burson . | |
| 2,237,212 | 4/1941 | Birdsong . | |
| 2,296,609 | 9/1942 | Gibson et al. . | |
| 2,511,083 | 6/1950 | Small | 52/547 |
| 3,222,831 | 12/1965 | Pritchard | 52/99 |
| 4,089,141 | 5/1978 | Heroux | 52/547 X |

FOREIGN PATENT DOCUMENTS

| | | | |
|---|---|---|---|
| 10328 | of 1898 | United Kingdom | 52/547 |
| 17011 | of 1905 | United Kingdom | 52/547 |

*Primary Examiner*—John E. Murtagh
*Assistant Examiner*—R. Chilcot
*Attorney, Agent, or Firm*—Henderson & Sturm

[57] ABSTRACT

A method and apparatus for installing elongated siding panel members in an overlapping fashion to a building or the like. A clip is utilized for fitting over each end of a first lower panel and extending downwardly therefrom to form a self for receiving, holding and properly spacing the overlap of a second panel to be installed next. Consequently, a panel can be held in place and nailed on one end thereof to a stud or the like of the building and the other end will remain in position until such time that the installer can move to the other end to nail or otherwise secure such siding panel on the other end thereof. The clip also serves to space the sliding panel members apart so that the material thereof can breath to reduce or eliminate swelling and buckling of the siding after it is installed.

1 Claim, 6 Drawing Figures

CLIP FOR HOLDING AND SPACING SIDING PANELS

This applicaton is a continuation-in-part application of my co-pending patent application Ser. No. 732,131 filed May 9, 1985 now abandoned.

TECHNICAL FIELD

The present invention relates generally to a method of installing overlapping siding, and more particularly to a clip and a method of using such clip for installing overlapping siding to a building.

BACKGROUND ART

The process of installing elongated overlapping siding members to a building requires that one person be on each end of a siding member to hold up the member and properly position it to have the proper overlap, and then to nail that end of the siding member to a stud or the like of a building. It has heretofore been difficult, if not entirely impractical, for one person alone to install siding to a building. Consequently, there is a need for an apparatus and a method for being able to accomplish this task more quickly and with one person, rather than two.

DISCLOSURE OF THE INVENTION

The present invention relates to a method and apparatus for installing elongated siding panel members in an overlapping fashion to a building or the like. A clip is utilized for fitting over each end of a first lower panel and extending downwardly therefrom to form a shelf for receiving, holding, protecting, and properly spacing the overlap of a second panel to be installed next. Consequently, a panel can be held in place and nailed on one end thereof to a stud or the like of the building and the other end will remain in position until such time that the installer can move to the other end to nail or otherwise secure such siding panel on the other end thereof. The clip also serves to space the siding panel members apart so that the material thereof can breathe to reduce or eliminate swelling and buckling of the siding after it is installed.

An object of the present invention is to provide an improved method and apparatus for installation of overlapping siding members on to a building.

Another object of the present invention is to provide a method and apparatus of the aforementioned type which enables one installer to install hardboard siding in a practical manner.

A further object of the present invention is to provide a method and apparatus for installing hardboard siding which quickly and dependably holds the siding members in a proper overlapping position and for permitting such procedure to be done more rapidly than heretofore.

A still further object of the present invention is to provide a clip which will serve the aforementioned installation function and will also serve as a spacer between siding members to permit adequate ventilation therebetween so as to eliminate swelling of the siding after it is installed.

Other objects, advantages, and novel features of the present invention will become apparent from the following detailed description of the invention when considered in conjunction with the accompanying drawings.

BEST MODE FOR CARRYING OUT THE INVENTION

Figure 1:
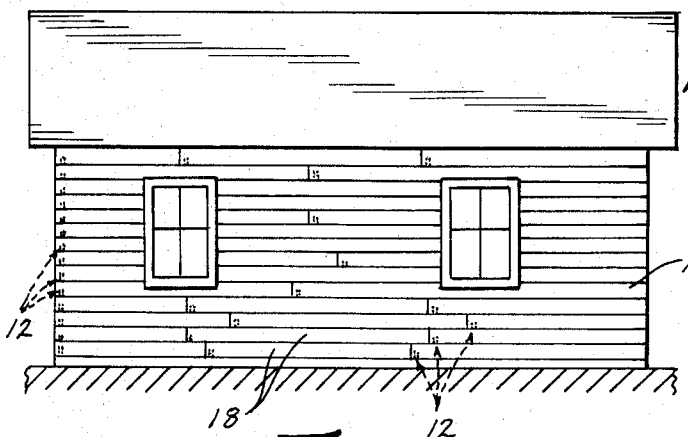
FIG. 1 is a side elevational view of a building having elongated siding members thereon which were installed utilizing the present invention.
Figure 2:
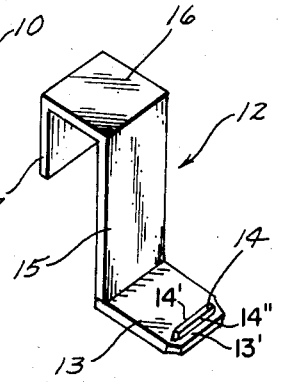
FIG. 2 is an enlarged perspective view of a clip for use in installing siding shown in FIG. 1.

Referring now to the drawings wherein like reference numerals designate identical or corresponding parts throughout the several views, FIG. 1 shows a building (10) having a plurality of siding members (11) attached thereto by use of clips (12), such clips (12) being shown more clearly in FIG. 2.

The clips (12) of the preferred embodiment thereof are injection molded polystyrene plastic having a approximate thickness of fifty thousandths of an inch. The clips (12) have a shelf (13) on the bottom thereof with an upstanding projection (14) disposed on the upper surface of the shelf and disposed proximate to, but spaced from the outer end thereof. An intermediate portion (15) is connected to a top portion (16) and a downwardly extending rear portion (17). This clip (12) is formed in one piece but it to be understood that it could be constructed in many other ways and of many other materials and still be within the scope of the present invention.

As can best be seen by reference to FIG. 2, the upstanding projection (14) is provided with a raised inboard projection surface (14'), and a raised outboard projection surface (14''). In addition the end portion of the shelf (13) that extends beyond the upstanding projection (14) defines a shelf lip (13'). The purpose and function of the aforementioned inboard (14') and outboard (14'') raised projection surfaces and the shelf lip (13') will be explained in greater detail further on in the specification.

Figure 3:
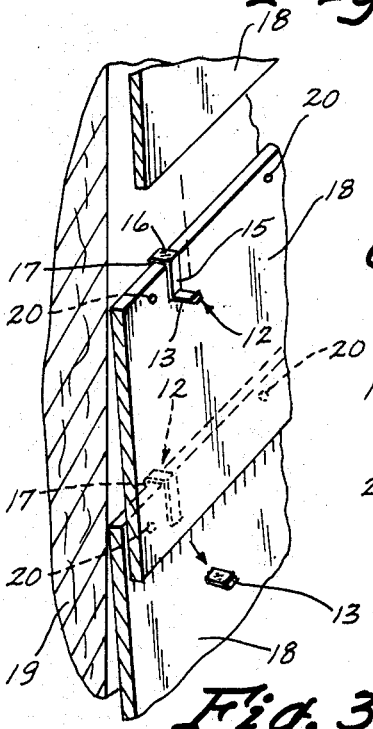
FIG. 3 is a partial perspective view showing the process of installing elongated siding panel members utilizing the clip of FIG. 2.
Figure 5:
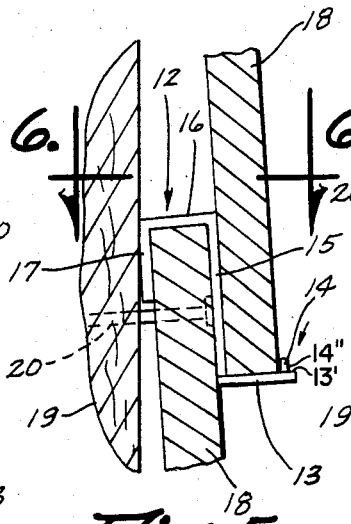
FIG. 5 is an enlarged partial cross-sectional view taken along line 5—5 of FIG. 4 and showing the lowermost one of the elongated panel members attached to a vertically oriented stud member and the upper one of the panel members shown in FIG. 5 being held in position by a clip member like the one shown in FIG. 2 in readiness to be attached to the stud member; and, FIG. 6 is a cross-sectional view taken along line 6—6 of FIG. 5.
Figure 6:
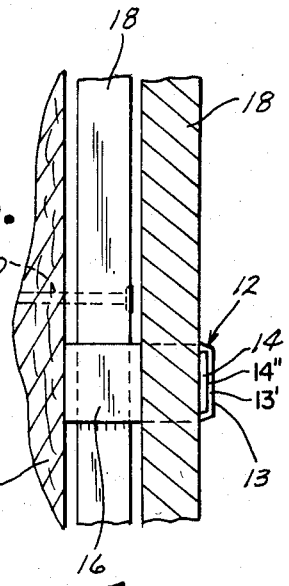
Figure 4:
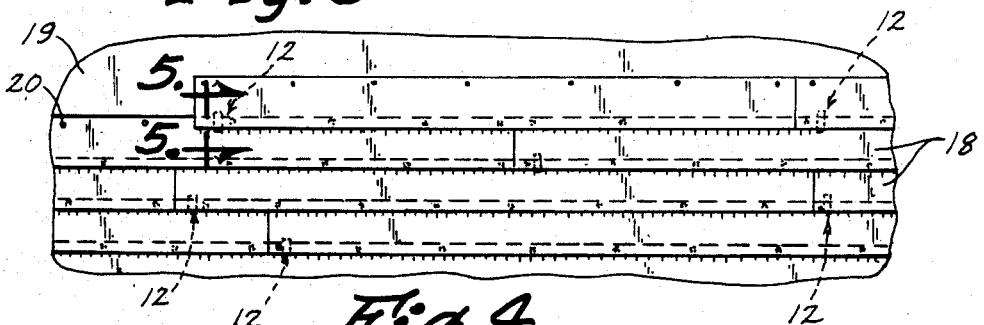
FIG. 4 is an enlarged side elevational partial view of some of the siding members shown in FIG. 1.

The installation of siding panels utilizing the clip (12) is shown in FIG. 3 wherein a lower siding panel (18) is nailed to a stud (19) by use of nails (20). One of the clips (12) is placed over the top of the next overlapping panel (18) on each end thereof, for example as shown in FIGS. 3, 5 and 6 wherein the portion (17) of the clip extends behind the lower panel (18) and the top portion (16) extends on top of the lower panel. Intermediate portion (15) extends between the upper and lower panels (18) to cause these panels (18) to be spaced apart for ventilation purposes. The shelf (13) supports the upper panel (18) and the raised inboard projection surface (14') of the upstanding projection (14) prevents the upper panel (18) from falling off of the shelf (13) while it is held in position to be nailed to the stud (19). After the shelf (13) has served its usefulness in holding upper panel (18) in position until after the panel (18) is nailed to the studs (19), the lower shelf (13) can be broken off, for example as shown in FIG. 3 and discarded.

As can be appreciated by reference to FIG. 5, the raised outboard projection surface (14") and the shelf lip (13') that extends beyond the projection (14) cooperating surfaces during the foreceable removal of the shelf (13) from the intermediate portion (15) in the final step of the siding installation process.

As shown in FIG. 5, when a downwardly directed force (indicated by the arrow) is exerted against the shelf lip (13') to fracture the juncture between the shelf (13) and the intermediate portion (15); the raised outboard projection (14') serves as a protective barrier element to prevent the downwardly directed force from coming into direct contact with the siding panel surface.

This last feature of the invention is particularly useful, in that even though the lip (12) is designed such that the shelf (13) may be removed manually, workmen will invariably use tools such as a screwdriver or the like to effect the removal of the shelf (13). In using a screwdriver or similar implement, the point of the implement will rest on the shelf lip (13') and the raised outboard projection (14") will prevent lateral displacement of the implement inwardly against the sidng panel surface. In the meantime, the intermediate portion (15) will remain in place and serve as a spacer between overlapping panel members (18) to allow ventilation and prevent the buildup of moisture within the panel members which would otherwise cause buckling of the siding panel members (18).

Obviously many modifications and variations of the present invention are possible in light of the above teachings. It is therefore to be understood that, within the scope of the appended claims, the invention may be practiced otherwise than as specifically described.

I claim:

1. Apparatus comprising:

a first elongated siding panel;

means for connecting said panel to a vertical surface;

clip means for supporting one end portion of a second panel in a predetermned overlapping position with respect to said first panel, said clip means including holding means extending over the top of and behind said first panel for preventing said clip means for moving downwardly, a horizontally disposed shelf means for abutment with the bottom of said one end portion of the second panel, an intermediate portion extending from the holding means to the shelf means, frangible means for connecting said shelf means to said intermediate portion, said intermediate portion being of a predetermined length for insuring said predetermined overlapping relationship of the second panel with respect to the first panel, and raised means formed proximate to, but spaced from, the outboard end of said horizontally disposed shelf means, whereby the inboard surface of said raised means prevents said second panel from slipping off of said shelf means; the outboard end of said shelf means provides a force receiving means whereby said shelf means can be removed from said intermediate portion by the application of a downwardly directed external force after said second panel is secured in place to said vertical surface; and, the outboard surface of the raised means serves as a protective barrier to prevent the direct application of said external force upon said second panel.

* * * * *